US009407007B2

(12) United States Patent
Hwang et al.

(10) Patent No.: US 9,407,007 B2
(45) Date of Patent: Aug. 2, 2016

(54) ANTENNA STRUCTURE IN WIRELESS COMMUNICATION SYSTEM AND OPERATION METHOD THEREOF

(71) Applicants: Samsung Electronics Co., Ltd, Gyeonggi-do (KR); Korea Advanced Institute of Science and Technology, Daejeon (KR)

(72) Inventors: Duck-Dong Hwang, Gyeonggi-do (KR); Chul-Soon Park, Daejeon (KR); In-Sang Song, Daejeon (KR); Inn-Yeal Oh, Daejeon (KR); Chae-Jun Lee, Daejeon (KR)

(73) Assignees: Samsung Electronics Co., Ltd., Suwon-si (KR); Korea Advanced Institute of Science and Technology, Daejeon (KR)

( * ) Notice: Subject to any disclaimer, the term of this patent is extended or adjusted under 35 U.S.C. 154(b) by 312 days.

(21) Appl. No.: 13/827,378

(22) Filed: Mar. 14, 2013

(65) Prior Publication Data

US 2013/0241782 A1 Sep. 19, 2013

(30) Foreign Application Priority Data

Mar. 14, 2012 (KR) ..... 10-2012-0026134

(51) Int. Cl.

| | |
|---|---|
| ***H01Q 3/24*** | (2006.01) |
| ***H01Q 9/16*** | (2006.01) |
| ***H01Q 7/00*** | (2006.01) |

(Continued)

(52) U.S. Cl.

CPC ..... *H01Q 3/247* (2013.01); *H01Q 1/246* (2013.01); *H01Q 7/00* (2013.01); *H01Q 9/16* (2013.01); *H01Q 9/20* (2013.01)

(58) Field of Classification Search

CPC ..... H01Q 3/247; H01Q 7/00; H01Q 9/16; H01Q 9/20

See application file for complete search history.

(56) References Cited

U.S. PATENT DOCUMENTS

| | | | | |
|---|---|---|---|---|
| 4,338,606 | A * | 7/1982 | Tada et al. | 343/744 |
| 4,358,769 | A * | 11/1982 | Tada et al. | 343/742 |
| 2003/0156069 | A1 * | 8/2003 | Ooe et al. | 343/713 |

(Continued)

FOREIGN PATENT DOCUMENTS

| | | |
|---|---|---|
| JP | 08-163015 | 6/1996 |
| KR | 10-2007-0034085 A | 3/2007 |

(Continued)

OTHER PUBLICATIONS

International Search Report dated Jun. 26, 2013 in connection with International Patent Application No. PCT/KR2013/001974, 3 pages.

(Continued)

*Primary Examiner* — Hoang V Nguyen
*Assistant Examiner* — Daniel J Munoz

(57) ABSTRACT

An antenna device in a wireless communication includes antenna wires of four sides which include three feeding points and have a loop structure and four main switches which are located among the antenna wires of the four sides, wherein the antenna device operates as a loop antenna when the antenna wires of the four sides are connected according to operations of the main switches and wherein the antenna device operates as dipole antennas when the antenna wires of the four sides are disconnected according to operations of the main switches.

19 Claims, 6 Drawing Sheets

(51) Int. Cl.
*H01Q 1/24* (2006.01)
*H01Q 9/20* (2006.01)

(56) References Cited

U.S. PATENT DOCUMENTS

| | | | | |
|---|---|---|---|---|
| 2008/0231526 | A1* | 9/2008 | Sato | 343/722 |
| 2008/0258991 | A1 | 10/2008 | Montgomery et al. | |
| 2009/0079573 | A1 | 3/2009 | Jiang et al. | |
| 2010/0309067 | A1 | 12/2010 | Tsou et al. | |
| 2011/0221647 | A1 | 9/2011 | Freiert | |

FOREIGN PATENT DOCUMENTS

| | | |
|---|---|---|
| KR | 10-2009-0068087 | 6/2009 |
| KR | 10-2010-0108810 | 10/2010 |
| KR | 10-2011-0002820 A | 1/2011 |

OTHER PUBLICATIONS

Written Opinion of the International Searching Authority dated Jun. 26, 2013, regarding International Patent Application No. PCT/KR2013/001974, 4 pages.

* cited by examiner

ANTENNA STRUCTURE IN WIRELESS COMMUNICATION SYSTEM AND OPERATION METHOD THEREOF

CROSS-REFERENCE TO RELATED APPLICATION(S) AND CLAIM OF PRIORITY

The present application is related to and claims the benefit under 35 U.S.C. §119(a) of a Korean patent application filed in the Korean Intellectual Property Office on Mar. 14, 2012 and assigned Serial No. 10-2012-0026134, the entire disclosure of which is hereby incorporated by reference.

TECHNICAL FIELD

The present disclosure relates to a wireless communication system. More particularly, the present disclosure relates to an antenna structure for supporting multi-frequency bands and an operation method thereof.

BACKGROUND

As various wireless communication technologies for supporting different frequency bands have been provided, technologies for effectively supporting multi-frequency bands have been researched and developed. For example, a wireless communication system has used a method of having a separate transmission and reception module while being classified according to each of frequency bands to support multi-frequency bands.

FIG. 1 illustrates a transmission and reception module of a Base Station (BS) for supporting multi-frequency bands.

As shown in FIG. 1, each of a macro BS 100-1 and a distributed BS 100-2, which supports multi-frequency bands of f1 to f4, includes a separate transmission and reception module for supporting each of the multi-frequency bands of f1 to f4. However, as described above, the method in which the BS includes the number of corresponding transmission and reception modules to support a plurality of frequency bands has a problem in that the more the number of supported frequency bands is increased, the more a hardware size is increased.

Therefore, recently, in order to miniaturize a size of the BS which supports the multi-frequency bands, there has been a method of reducing a separation distance of an antenna array configuring an antenna unit. However, there is a limit to miniaturize the size of the BS using only the method of the separation distance of the antenna array.

SUMMARY

To address the above-discussed deficiencies, embodiments of the present disclosure provide an antenna structure in a wireless communication system and an operation method thereof.

Certain embodiments of the present disclosure provide an antenna structure for combining and integrating a dipole antenna and a loop antenna in a wireless communication system and an operation method thereof.

Certain embodiments of the present disclosure provide a method and apparatus for configuring an antenna array using antennas in which a dipole antenna and a loop antenna are combined and integrated the combined antenna in a wireless communication system.

Certain embodiments of the present disclosure provide a method and apparatus for supporting two frequency bands through an antenna array configured using antennas in which a dipole antenna and a loop antenna are combined and integrated in a wireless communication system.

In accordance with certain embodiments of the present disclosure, an antenna device in a wireless communication includes antenna wires of four sides. The antenna wires of four sides include three feeding points and have a loop structure and four main switches, which are located among the antenna wires of the four sides. The antenna device operates as a loop antenna when the antenna wires of the four sides are connected according to operations of the main switches, and the antenna device operates as dipole antennas when the antenna wires of the four sides are disconnected according to operations of the main switches.

In accordance with certain embodiments of the present disclosure, an antenna array device in a wireless communication includes a plurality of antenna elements. Each of the antenna elements have a predetermined separation distance, wherein each of the antenna elements which has a structure in which a dipole antenna is integrated in each of both sides of one loop antenna, and wherein each of the antenna elements supports different two frequency bands.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 2 through 6B, discussed below, and the various embodiments used to describe the principles of the present disclosure in this patent document are by way of illustration only and should not be construed in any way to limit the scope of the disclosure. Those skilled in the art will understand that the principles of the present disclosure can be implemented in any suitably arranged wireless communication system or device. Exemplary embodiments of the present disclosure will be described herein below with reference to the accompanying drawings. In the following description, well-known functions or constructions are not described in detail because they would obscure the invention in unnecessary detail. Also, the terms used in the present disclosure are defined according to the functions of the elements of the present disclosure and can vary depending on user or operator's intention and usage. That is, the terms used herein should be understood based on the descriptions made throughout the present disclosure.

Embodiments of the present disclosure provide a structure of an antenna, in which a dipole antenna and a loop antenna are combined, for supporting two frequency bands and an operation method thereof.

Figure 2:
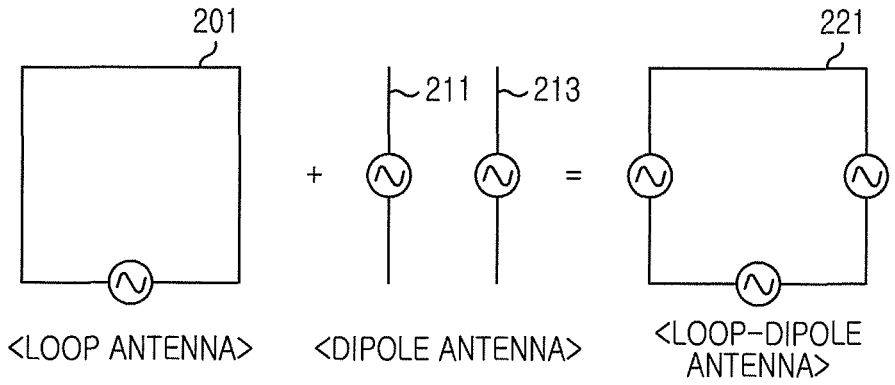
FIG. 2 illustrates a loop-dipole antenna in which a dipole antenna and a loop antenna are combined according to embodiments of the present disclosure.

FIG. 2 illustrates an antenna of a type in which a loop antenna and a dipole antenna are combined according to embodiments of the present disclosure.

As shown in FIG. 2, an antenna 221 has a type in which a loop antenna 201 and dipole antennas 211 and 213 are integrated in one structure. Hereinafter, for the convenience of description, the loop antenna 201 are described with reference to a square loop antenna, which is a resonant antenna that operates wherein the sum of the lengths of the four sides of the entire loop is $1\lambda$, and each side thereof is $\lambda/4$ in length. The dipole antennas 211 and 213 are described with reference to half wavelength dipole antennas, each of the dipole antennas 211 and 213 operates with a half wavelength length of a center frequency. However, the present disclosure is not limited to the half wavelength dipole antenna and the square loop antenna, and can be also applied to a dipole antenna of a different shape and a loop antenna of a different shape. Hereinafter, for the convenience of description, the antenna 221 of the type in which the loop antenna 201 and the dipole antennas 211 and 213 are combined and integrated is referred to as a loop-dipole antenna.

Figure 3:
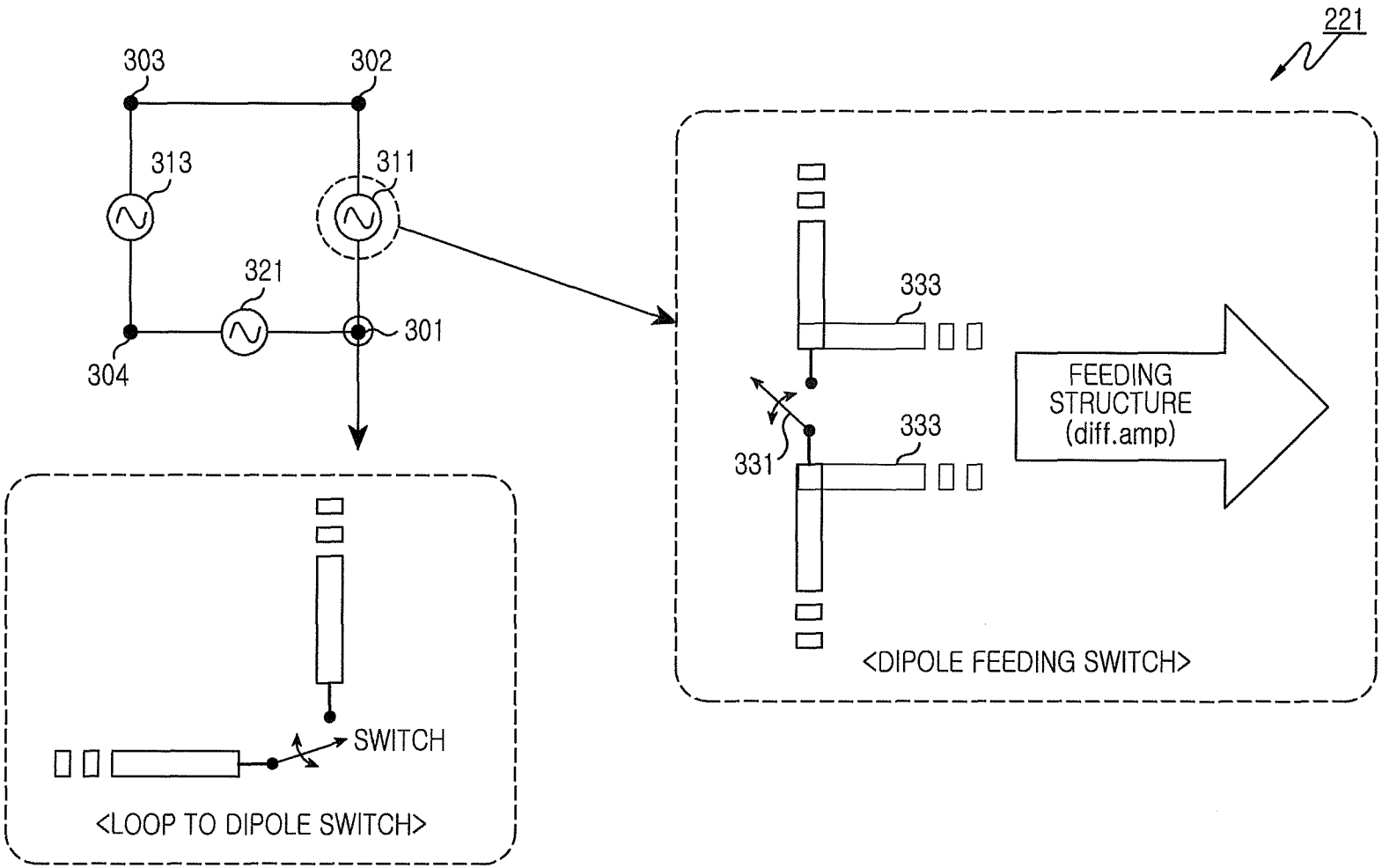
FIG. 3 illustrates a detailed structure of a loop-dipole antenna according to embodiments of the present disclosure.

FIG. 3 illustrates a detailed structure of a loop-dipole antenna in which a loop antenna and dipole antennas are combined according to embodiments of the present disclosure.

Referring to FIGS. 2 and 3, the loop-dipole antenna denoted by 221 includes first to fourth switches 301 to 304, first and second feeding points 311 and 313 for operations of dipole antennas, and a third feeding point 321 for an operation of a loop antenna.

The first to fourth switches 301 to 304 can operate as one loop antenna 201 or two dipole antennas 211 and 213 through switching. That is, when the first to fourth switches 301 to 304 are simultaneously turned off, a wire of four sides of the loop-dipole antenna 221 is divided. Accordingly, wires of symmetric both sides of the loop-dipole antenna 221 can operate as the dipole antennas 211 and 213 by the first and second feeding points 311 and 313 of the symmetric both sides thereof. On the other hand, when the first to fourth switches 301 to 304 are simultaneously turned on, all the wires of the four sides of the loop-dipole antenna 221 are connected with one other. Accordingly, the loop-dipole antenna 221 can operate as the loop antenna 201 by the third feeding point 321.

In accordance with embodiments of the present disclosure, the first to fourth switches 301 to 304 are described above with reference to when they are located on vertices of the loop-dipole antenna 221. However, the first to fourth switches 301 to 304 can be disposed in certain positions where wires of both sides including the first and second feeding points 311 and 313 have the same length when they are turned off. That is, the first to fourth switches 301 to 304 can be disposed in certain positions where the two dipole antennas 211 and 213, which operate when they are turned off, have the same length.

The first and second feeding points 311 and 313 are symmetrically located on both sides of the loop-dipole antenna 221 and supply current such that the corresponding both sides thereof operate as the dipole antennas 211 and 213. Particularly, in accordance with embodiments of the present disclosure, each of the first and second feeding points 311 and 313 includes a switch 331.

When the switches 331 included in each of the first and second feeding points 311 and 313 are turned on/off, both wires of the corresponding feeding point are connected or disconnected. Accordingly, the loop-dipole antenna 221 operates as the loop antenna 201 or the dipole antennas 211 and 213. That is, the switch 331 in the first feeding point 311 disconnects both wires of the first feeding point 311 such that the loop-dipole antenna 221 operates as the two dipole antennas 211 and 213, or the switch 331 connects both the wires of the first feeding point 311 such that the loop-dipole antenna 221 operates as the one loop antenna 201. When the switch 331 included in the first feeding point 311 is turned on and both the wires of the first feeding point 311 are connected with each other, a resistance value of a feeding line 333 of the first feeding point 311 is greater than a resistance value of both the wires connected to the switch 331. Accordingly, the feeding line 333 does not influence the loop-dipole antenna 221 operations as the loop antenna 201.

The third feeding point 321 supplies current such that the loop-dipole antenna 221 operates as the loop antenna. Herein, the third feeding point 321 for supplying current for an operation of the loop antenna and the first and second feeding points 311 and 313 for supplying current for operations of the dipole antennas exist on different sides of the loop-dipole antenna 221. That is, a side including the third feeding point 321 is orthogonal to both sides that include the first and second feeding points 311 and 313.

As described above, the loop-dipole antenna 221 can operate as the one loop antenna 201 or as the two dipole antennas 211 and 213 by turning on/off the first to fourth switches 301 to 304 and the switch 331 included in each of the first and second feeding points 311 and 313 according to control of a controller (not shown). In certain embodiments, a frequency band supported when the loop-dipole antenna 221 operates as the loop antenna 201 differs from a frequency band supported when the loop-dipole antenna 221 operates as the dipole antennas 211 and 213. In certain embodiments, the frequency band supported by each of the loop antenna 201 and the dipole antennas 211 and 213 of the loop-dipole antenna 221 can be changed according to a length of each of the loop antenna 201 and the dipole antennas 211 and 213. Particularly, the frequency band supported by the dipole antennas 211 and 213 can be changed according to positions of the first to fourth switches 301 to 304. For example, when the first to fourth switches 301 to 304 are located on vertices of the loop-dipole antenna 221 and when the first to fourth switches 301 to 304 are symmetrically located on both wires that include the first and second feeding points 311 and 313, the dipole antennas 211 and 213 support different frequency bands.

Also, as described above, when the first to fourth switches 301 to 304 is turned off and both the sides of the loop-dipole antenna 221 operate as the dipole antennas 211 and 213 according to embodiments of the present disclosure, sides of the loop-dipole antenna 221, except for both the dipole antenna sides of the loop-dipole antenna 221 are orthogonal to both the sides that operate as the dipole antennas 211 and 213. Accordingly, the side(s) except for both the dipole antenna sides do not influence operation of the dipole antenna 211 and 213.

Certain embodiments of the present disclosure include a method of configuring an antenna array using loop-dipole antennas.

Figure 4:
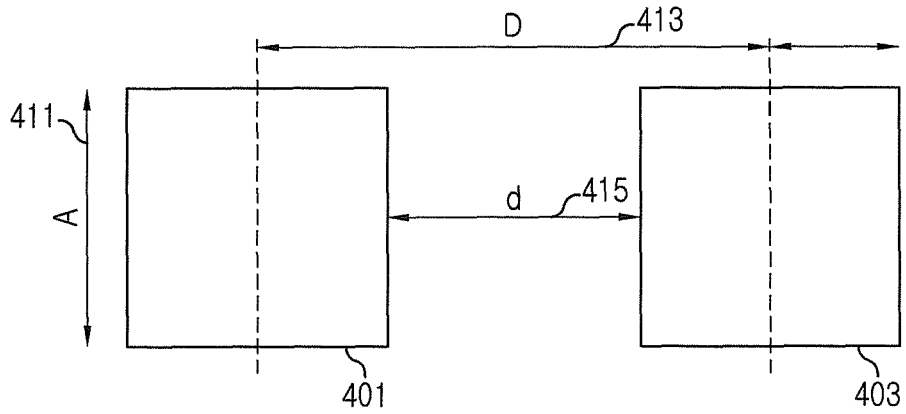
FIG. 4 illustrates a separation distance between loop-dipole antennas according to embodiments of the present disclosure.

FIG. 4 illustrates a separation distance between loop-dipole antennas according to embodiments of the present disclosure.

As shown in FIG. 4, in case of square loop-dipole antennas 401 and 403 according to embodiments of the present disclosure, a length of a side on each is shown in Equation 1 below.

$$A = \frac{\lambda_1}{4} = \frac{\lambda_2}{2}, \lambda_1 = \lambda_2 \tag{1}$$

Herein, A 411 denotes a length of each of four sides that compose each of the loop-dipole antennas 401 and 403. $\lambda_1$ denotes a corresponding wavelength when each of the loop-dipole antennas 401 and 403 operates as a loop antenna. $\lambda_2$ denotes a corresponding wavelength when each of the loop-dipole antennas 401 and 403 operates as dipole antennas. That is, the length A 411 of each of the four sides of the loop-dipole antennas 401 and 403 can be determined using a characteristic of a loop antenna that operates when a length of one side thereof is $\lambda/4$ and a characteristic of dipole antennas that operate with a $\lambda/2$ length.

Also, when an antenna array is configured using a plurality of loop-dipole antennas 401 and 403, a separation distance between the loop-dipole antennas 401 and 403 is shown in the system of equations in Equation (2).

$$D = \frac{\lambda_1}{2} \tag{2}$$

$$d = D - 2 \times \frac{\lambda_1}{8} = \frac{\lambda_1}{4} = \frac{\lambda_2}{2}$$

Herein, D 413 denotes a separation distance between center points of the loop-dipole antennas 401 and 403. While d (415 denotes a separation distance between adjacent sides of the loop-dipole antennas 401 and 403. That is, the separation distance D 413 between the center axes of the loop-dipole antennas 401 and 403 for configuring, the antenna array and the separation distance d 411 between sides of the loop-dipole antennas 401 and 403 can be determined such that a separation distance between loop antennas is 212 when each of the loop-dipole antennas 401 and 403 operates as the loop antenna 201 of FIG. 2. The separation distance D 413 and the separation distance d 411 can be determined such that the separation distance between dipole antennas is 212 when each of the loop-dipole antennas 401 and 403 operates as the dipole antennas 211 and 213 of FIG. 2.

Figure 5A:
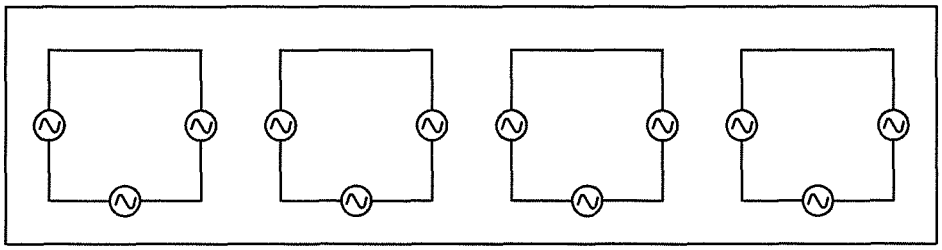
FIGS. 5A to 5C illustrate a structure of an antenna array which is equipped with loop-dipole antennas and an operation method of the antenna array according to embodiments of the present disclosure.
Figure 5B:
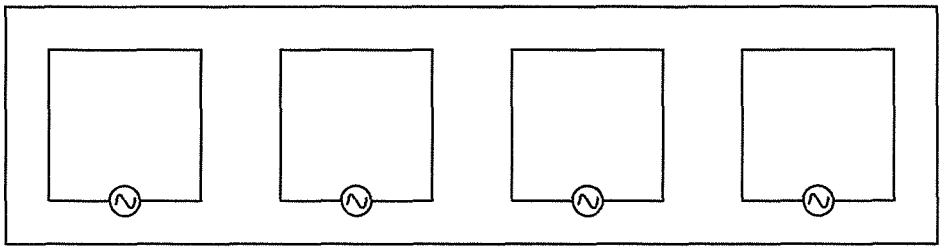
Figure 5C:
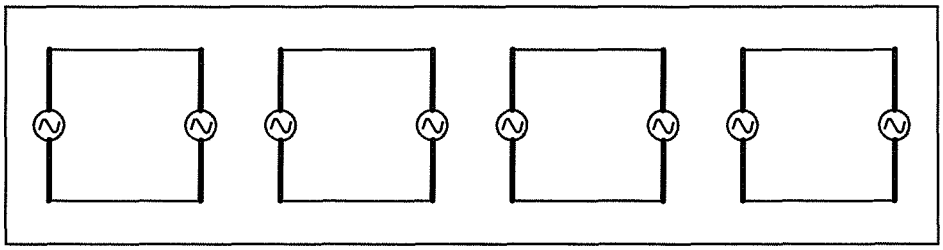

FIGS. 5A to 5C illustrate a structure of an antenna array equipped with loop-dipole antennas and an operation method thereof according to embodiments of the present disclosure.

As shown in FIG. 5A, an antenna array can be configured using a plurality of loop-dipole antennas according to embodiments of the present disclosure. Herein, a length of each of the loop-dipole antennas, a length of each of four sides in each of the loop-dipole antennas, and a separation distance between the loop-dipole antennas can be determined according to Equations (1) and (2) based on frequencies to be supported in a corresponding system. The antenna array can operate as a loop antenna array and can support a low frequency band $f_L$, or can operate as a dipole antenna array and can support a high frequency band $f_H$, by turning on/off switches thereof according to control of a controller (not shown).

That is, as shown in FIG. 5B, an antenna array equipped with four loop-dipole antennas can operate as an antenna array equipped with four loop antennas and supports a low frequency band $f_L$ by turning on switches thereof according to control of the controller (not shown). In certain embodiments, a separation distance between the loop antennas is a half wavelength.

Also, as shown in FIG. 5C, an antenna array equipped with four loop-dipole antennas operates as an antenna array equipped with eight dipole antennas and supports a high frequency band $f_H$ by turning off switches thereof according to control of the controller (not shown). In certain embodiments, a separation distance between the dipole antennas is a half wavelength.

As described above, it is ideal that the high frequency band $f_H$ is twice as likely as the low frequency band $f_L$ to have frequencies. However, in applied practice the high frequency band $f_H$ is not twice as likely as the low frequency band 11 to have frequencies according to positions of switches included in each of the loop-dipole antennas.

Figure 1:
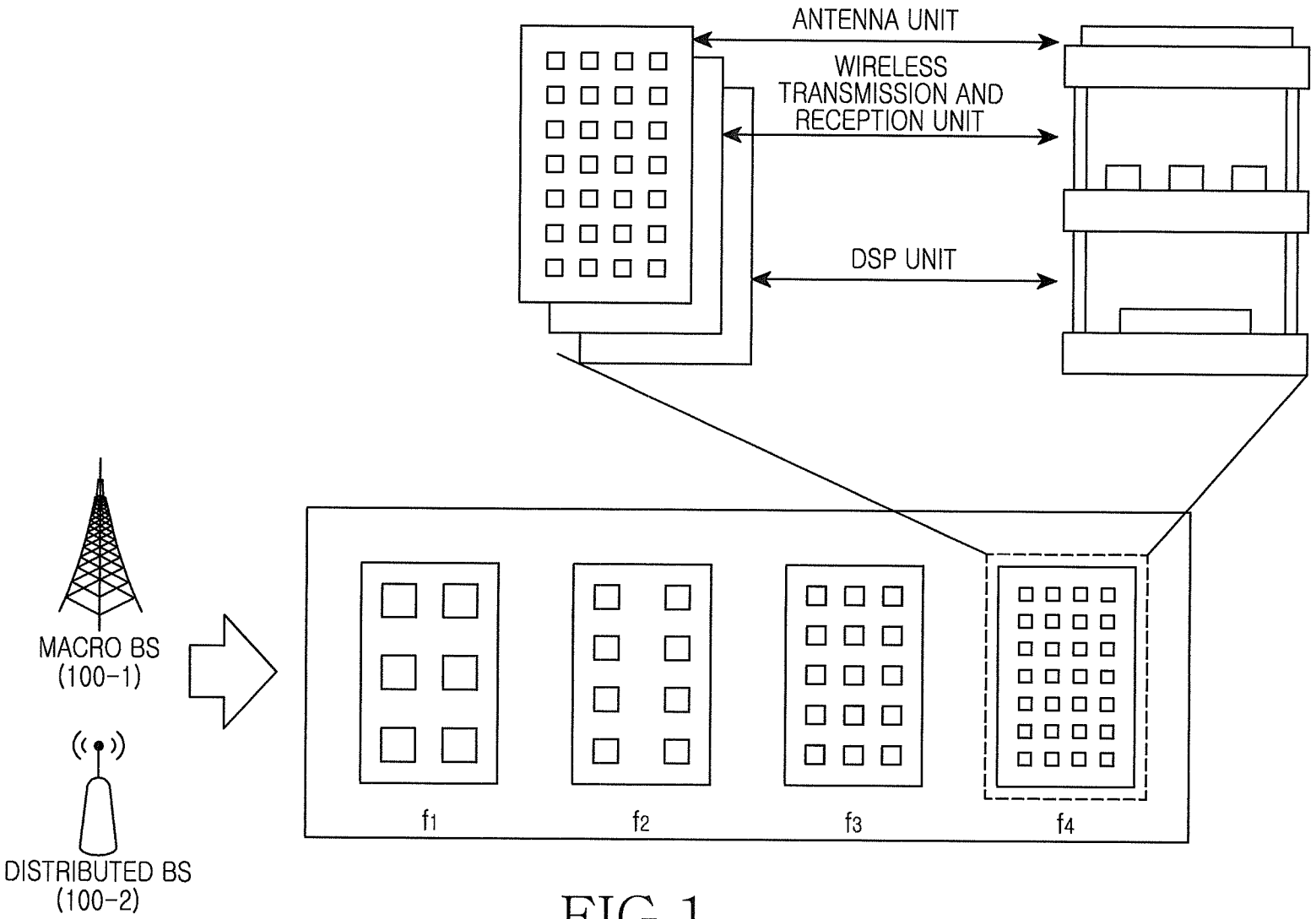
FIG. 1 illustrates a transmission and reception module of a BS for supporting multi-frequency bands according to the present disclosure.
Figures 6A, 6B:
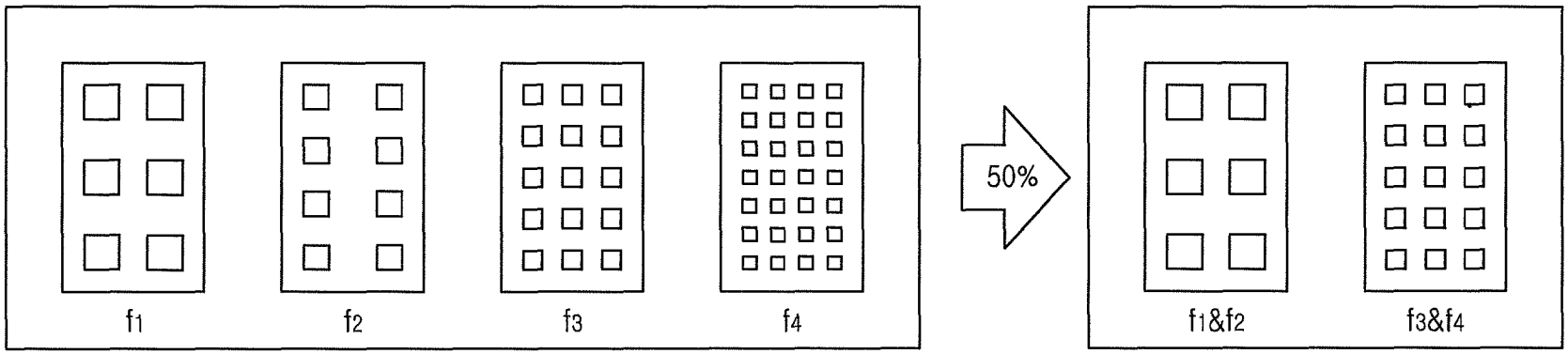
FIG. 6A illustrates an antenna array integrated structure of a BS of FIG. 1 for supporting multi-frequency bands.
FIG. 6B illustrates an antenna array integrated structure of a BS for supporting multi-frequency bands according to embodiments of the present disclosure.

FIG. 6A illustrates an antenna array integrated structure of a BS for supporting multi-frequency bands according to FIG. 1 and FIG. 6B illustrates a BS for supporting multi-frequency bands according to embodiments of the present disclosure. Herein, it is assumed that the BS according to FIG. 6A and the BS of FIG. 6B according to embodiments of the present disclosure support multi-frequency bands of $f_1$ to $f_4$.

Referring to FIGS. 6A and 6B, the BS according to FIG. 6A includes separate antenna arrays which are configured while being classified according to a frequency band of each of $f_1$ to $f_4$. However, the BS of FIG. 6B using a loop-dipole antenna according to embodiments of the present disclosure includes one antenna array while being classified according to two frequency bands. That is, the BS of FIG. 6B includes an antenna array for supporting frequency bands of $f_1$ and f2 and an antenna array for supporting frequency bands of $f_3$ and $f_4$ using the loop-dipole antenna. Accordingly, an antenna module of the BS of FIG. 6B can be reduced in size by 50% in comparison with an antenna module of the BS of FIG. 6A.

An antenna device according to embodiments of the present disclosure can reduce a size of a BS through an antenna structure for supporting two frequency bands by combining and integrating a dipole antenna and a loop antenna in a wireless communication system for supporting multi-frequency bands. Also, an antenna device according to embodiments of the present disclosure can configure an antenna array easily by securing a separation distance between positions of feeding points between a dipole antenna and a loop antenna. Also, an antenna device according to embodiments of the present disclosure can implement an antenna array at low cost by using only a dipole antenna and loop antenna. Also, an antenna device according to embodiments of the present disclosure can reduce an error generation probability generated due to a simple structure.

While the present disclosure has been particularly shown and described with reference to exemplary embodiments thereof, it will be understood by those skilled in the art that various changes in form and details may be made therein without departing from the spirit and scope of the present disclosure as defined by the appended claims.

What is claimed is:

1. An antenna device in a wireless communication system, the antenna device comprising:

antenna wires of four sides including three feeding points and having a loop structure, each feeding point configured to supply current to the antenna device; and four main switches located among the antenna wires of the four sides, wherein the antenna device operates as a loop antenna when the antenna wires of the four sides are connected according to operations of the main switches, and wherein the antenna device operates as dipole antennas when the antenna wires of the four sides are disconnected according to operations of the main switches.

2. The antenna device of claim 1, wherein the three feeding points are disposed on three of the antenna wires of the four sides, respectively, wherein the loop structure comprises two sides symmetrical to each other, each of the symmetric two sides including a feeding point, each feeding point including a sub-switch configured to connect both wires of the symmetric two sides including the feeding point, and wherein the sub-switch connects both the wires of the symmetric two sides including the feeding point when the antenna device operates as the loop antenna and the sub-switch disconnects both the wires of the symmetric two sides including the feeding point when the antenna device operates as the dipole antennas.

3. The antenna device of claim 2, wherein, when the antenna device operates as the dipole antennas, each of the symmetric two sides including the feeding point receives current from the corresponding feeding point and operates as two dipole antennas.

4. The antenna device of claim 1, wherein the antenna device supports different frequency bands according to operations of the main switches.

5. The antenna device of claim 1, wherein a length of each of the four sides is one-fourth a wavelength supported by the antenna device when the antenna device operates as a loop antenna.

6. The antenna device of claim 5, wherein a length of each of the four sides is one-half a wavelength supported by the antenna device when the antenna device operates as a dipole antennas.

7. An antenna array device in a wireless communication system, the antenna array device comprising a plurality of antenna elements, each of the antenna elements having a predetermined separation distance, wherein each of the antenna elements:

includes a structure of a dipole antenna integrated in each of two sides of a one loop antenna and supports different two-frequency bands, wherein each of the antenna elements includes: antenna wires of four sides including three feeding points and having a loop structure each feeding point configured to supply current to the antenna array device; and four main switches located among the antenna wires of the four sides, wherein each of the antenna elements operates as the loop antenna when the antenna wires of the four sides are connected according to operations of the main switches, and wherein each of the antenna elements operates as the dipole antennas when the antenna wires of the four sides are disconnected according to operations of the main switches.

8. The antenna array device of claim 7, wherein the three feeding points are disposed on three of the antenna wires of the four sides, respectively, wherein the loop structure comprises two sides symmetrical to each other, each of the symmetric two sides including a feeding point including a sub-switch for connecting both wires of the symmetric two sides including the feeding point, and wherein the sub-switch connects both the wires of the symmetric two sides including the feeding point when each of the antenna elements operates as the loop antenna and the sub-switch disconnects both the wires of the symmetric two sides including the feeding point when each of the antenna elements operates as the dipole antennas.

9. The antenna array device of claim 8, wherein, when each of the antenna elements operates as the dipole antenna, each of the symmetric two sides including the feeding point receives current from the corresponding feeding point and operates as two dipole antennas.

10. The antenna array device of claim 7, wherein each of the antenna elements supports different frequency bands according to operations of the main switches.

11. The antenna array device of claim 7, wherein the predetermined separation distance is a length corresponding to a half wavelength of a frequency supported by each of the antenna elements.

12. The antenna array device of claim 11, wherein the predetermined separation distance is a separation distance between center axes of the loop antennas when each of the antenna elements operates as the loop antenna.

13. The antenna array device of claim 11, wherein the predetermined separation distance is a separation distance between the two sides of the one loop antenna that operate as the dipole antennas when each of the antenna elements operates as the dipole antenna.

14. A method of operating an antenna device in a wireless communication system, the method comprising:

operating four main switches of an antenna device, wherein the antenna device comprises:

antenna wires of four sides including three feeding points and having a loop structure, each feeding point configured to supply current to the antenna device, and the four main switches located among the antenna wires of the four sides, wherein the antenna device operates as a loop antenna when the antenna wires of the four sides are connected according to operations of the main switches, and wherein the antenna device operates as dipole antennas when the antenna wires of the four sides are disconnected according to operations of the main switches.

15. The method of claim 14, wherein the three feeding points are disposed on three of the antenna wires of the four sides, respectively, wherein the loop structure comprises two sides symmetrical to each other, each of the symmetric two sides including a feeding point, each feeding point including a sub-switch configured to connect both wires of the symmetric two sides including the feeding point; and the method further comprising:

when the antenna device operates as the loop antenna, connecting, by the sub-switch, both the wires of the symmetric two sides including the feeding point; and when the antenna device operates as the dipole antennas, disconnecting, by the sub-switch, both the wires of the symmetric two sides including the feeding point.

16. The method of claim 15, further comprising: when the antenna device operates as the dipole antennas, receiving, by each of the symmetric two sides including the feeding point, current from the corresponding feeding point and operates as two dipole antennas.

17. The method of claim 14, wherein the antenna device supports different frequency bands according to operations of the main switches.

18. The method of claim 14, wherein a length of each of the four sides is one-fourth a wavelength supported by the antenna device when the antenna device operates as a loop antenna.

19. The method of claim 18, wherein a length of each of the four sides is one-half a wavelength supported by the antenna device when the antenna device operates as a dipole antennas.

* * * * *